US007390949B2

(12) United States Patent
Wanne

(10) Patent No.: US 7,390,949 B2
(45) Date of Patent: Jun. 24, 2008

(54) SAXOPHONE AND CLARINET MOUTHPIECE CAP

(75) Inventor: Allen Theodore Wanne, Bellingham, WA (US)

(73) Assignee: Wanne, Inc., Bellingham, WA (US)

( * ) Notice: Subject to any disclaimer, the term of this patent is extended or adjusted under 35 U.S.C. 154(b) by 0 days.

(21) Appl. No.: 11/346,422

(22) Filed: Feb. 1, 2006

(65) Prior Publication Data

US 2007/0175314 A1 Aug. 2, 2007

(51) Int. Cl.
*G10D 7/08* (2006.01)

(52) U.S. Cl. ..... 84/385 A

(58) Field of Classification Search ..... 84/383 R, 84/383 A, 380 R, 385 A, 398, 399
See application file for complete search history.

(56) References Cited

U.S. PATENT DOCUMENTS

| | | | | | |
|---|---|---|---|---|---|
| 2,600,853 | A | * | 6/1952 | Crescenzi | 84/383 R |
| 2,837,003 | A | * | 6/1958 | Collis | 84/383 R |
| 4,991,483 | A | * | 2/1991 | Petit | 84/383 R |
| 6,150,593 | A | * | 11/2000 | Holden | 84/383 R |
| D475,735 | S | * | 6/2003 | Louis | D17/99 |

* cited by examiner

*Primary Examiner*—Kimberly R Lockett
(74) *Attorney, Agent, or Firm*—Gottlieb, Rackman & Reisman, P.C.

(57) ABSTRACT

A protective cap for the mouthpiece of a musical instrument includes a cap body fitting over the mouthpiece tip and an extension that is positively captured by a ligature normally holding the reed for the mouthpiece. The cap is designed to replace the reed when the instrument is left idle.

11 Claims, 6 Drawing Sheets

SAXOPHONE AND CLARINET MOUTHPIECE CAP

RELATED APPLICATIONS

None

BACKGROUND OF THE INVENTION

A. Field of Invention

The present invention pertains to an improved cap covering and protecting the mouthpiece of a saxophone or clarinet mouthpiece.

B. Description of the Prior Art

Woodwind instruments are referred to herein as musical instruments consisting of a main body used to define a column of air. As is well known in the art, within the body the acoustic characteristics of the column may be modified by various means that are beyond the scope of this invention. Importantly, the air column is vibrated-by a reed disposed in a mouthpiece attached to the body intake by means of a ligature made of metal, or other material. The ligature normally extends circumferentially around the entire outer body of the mouthpiece. The ligature is provided with an integral tightening mechanism that is used to secure the reed to the mouthpiece. Because of the mechanical coupling between the ligature, the mouthpiece and the reed, the structure ligature plays a roll in the sound produced by the instruments, and various types of ligatures are available from different companies, each having its own sound characteristics.

The ligature is normally permanently mounted to the mouthpiece but before performances or practice sessions, a musician has a choice of leaving the reed attached to the mouthpiece, or removing from the instrument.

Because both the reed and the ligature are relative fragile members and because they do play an important role in the operation of the respective musical instruments, such as saxophones, a protective cap is normally attached to the mouthpiece to protect these members. As will be described in more detail below, the protective cap is sized and shaped to form an interference fit with the mouthpiece and the ligature, and only used when the instrument is idle and not in use.

Over time, the cap gets warn away or gets distended, and therefore, the interference fit is not sufficient to hold the cap securely on the mouthpiece, but instead, it falls off and gets lost.

Moreover, when the ligature holds the reed in place, its element and the reed are held tightly against the mouthpiece and there is no movement therebetween. Accordingly, the cap is stable on the mouthpiece as well (especially when it's new). However, if the reed is removed, the ligature is held loosely on the mouthpiece, and, as the musical instrument is being carried, the ligature can move and shift with respect to the mouthpiece. If a cap is mounted on the mouthpiece, because of the movement of the ligature, the cap cannot be secured adequately on the mouthpiece and can fall off very easily.

SUMMARY OF THE INVENTION

A mouthpiece cap for a musical instrument constructed in accordance with this invention is adapted to be used with a mouthpiece having a ligature with a screw. The cap includes a hollow body partially fitting over the mouthpiece; and an extension attached to said body and shaped to be engaged by said screw when said hollow body is disposed over said mouthpiece. Preferably, the musical instrument includes a removable reed and the extension replaces a portion of the reed.

Preferably the extension is shaped to be captured between said screw and the body of said mouthpiece.

Preferably, the body is shaped to be inserted longitudinally over the mouthpiece with said extension passing simultaneously into said ligature.

Preferably, the cap's hollow body and the extension form a single unitary piece.

In another aspect of the invention, a cap and mouthpiece assembly is disclosed with a mouthpiece having an elongated mouthpiece body with an attachment end for attaching to a musical instrument, a lip and a circumferential surface between said lip and said attachment end; a ligature disposed on said circumferential surface; a removable reed having a reed end extending to said ligature and being captured by said ligature; and a cap having a cap body sized and shaped to fit over said tip and an extension attached to said cap body and shaped to be captured by said ligature; wherein said reed is replaced by said cap to provide protection to said tip while the musical instrument is idle.

Preferably the reed has a reed end captured by said ligature and wherein said extension has the approximate shape and size of said reed end to fit into said ligature.

Preferably, the ligature includes a capture screw for selectively capturing one of said reed and said cap.

Preferably, one of an end of said reed and said extension are captured between said screw and said mouthpiece.

Preferably, the cap and the extension are forming a unitary piece.

DETAILED DESCRIPTION OF THE INVENTION

Figure 1:
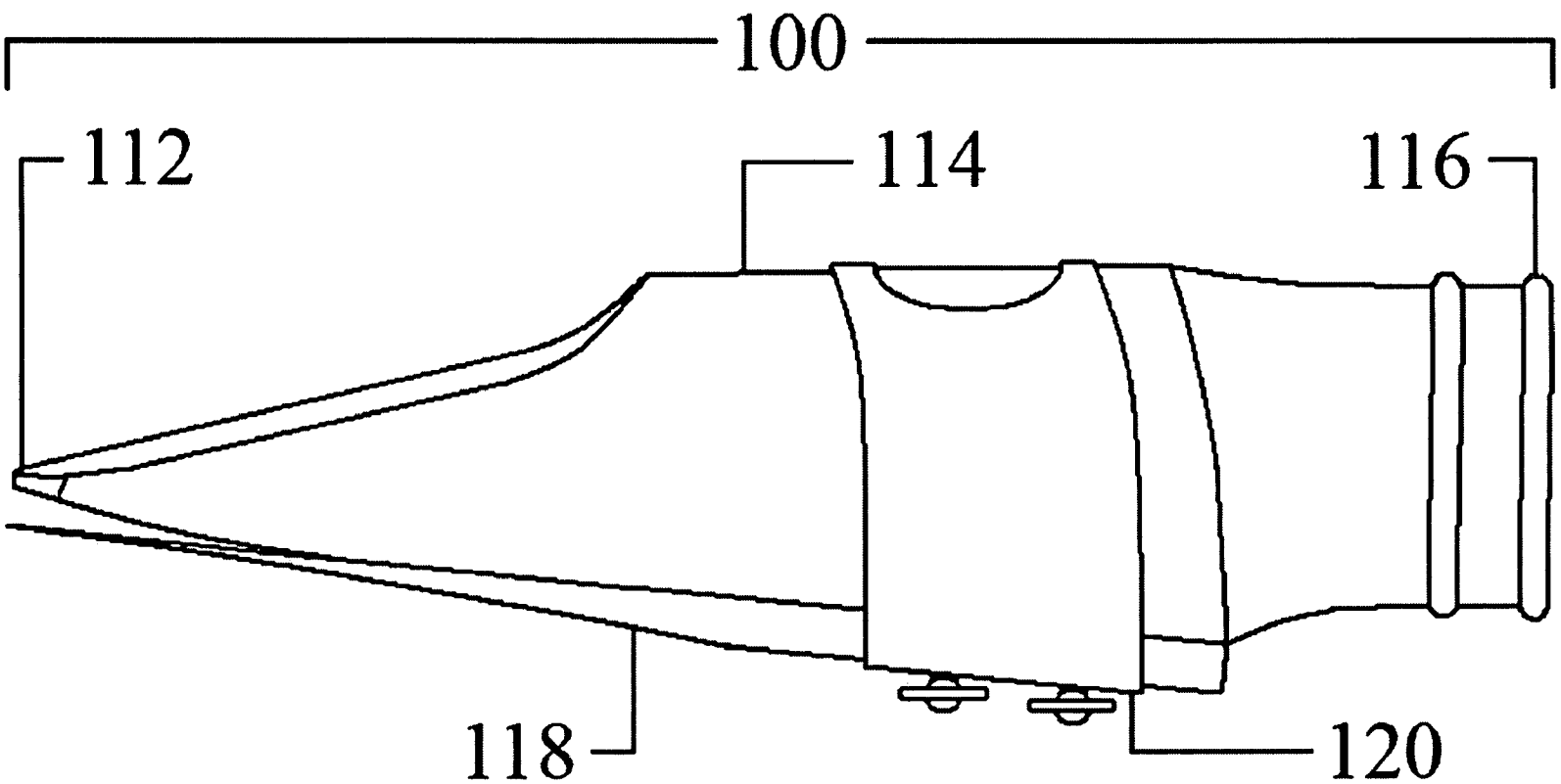
FIG 1 PRIOR ART
FIG. 1 shows a side elevational view of typical mouthpiece for a musical instrument.

FIG. 1 shows a typical saxophone or clarinet mouthpiece 100, it being understood that the invention may be used to protect other instruments as well. The mouthpiece 100 includes a somewhat cylindrical body 114 having a narrowed portion 116 at one end used to attach the mouthpiece to the body of an appropriate instrument (not shown). The opposite end of the mouthpiece 100 is formed with a tip 112. The body 100 is hollow and a hole (not shown) leads into the interior of the body. The body 100 also has a reed seat (not shown). A ligature 120 is attached to the body by forming a band around said body, and extending over the seat. The ligature includes a thumbscrew 115 that extends toward the seat on the body 100. A reed 118 extends from the reed seat until the tip 112 as shown and is pressed by the thumbscrew 115 against the reed seat thereby securing the reed 118 to the mouthpiece 100.

Figure 2A:
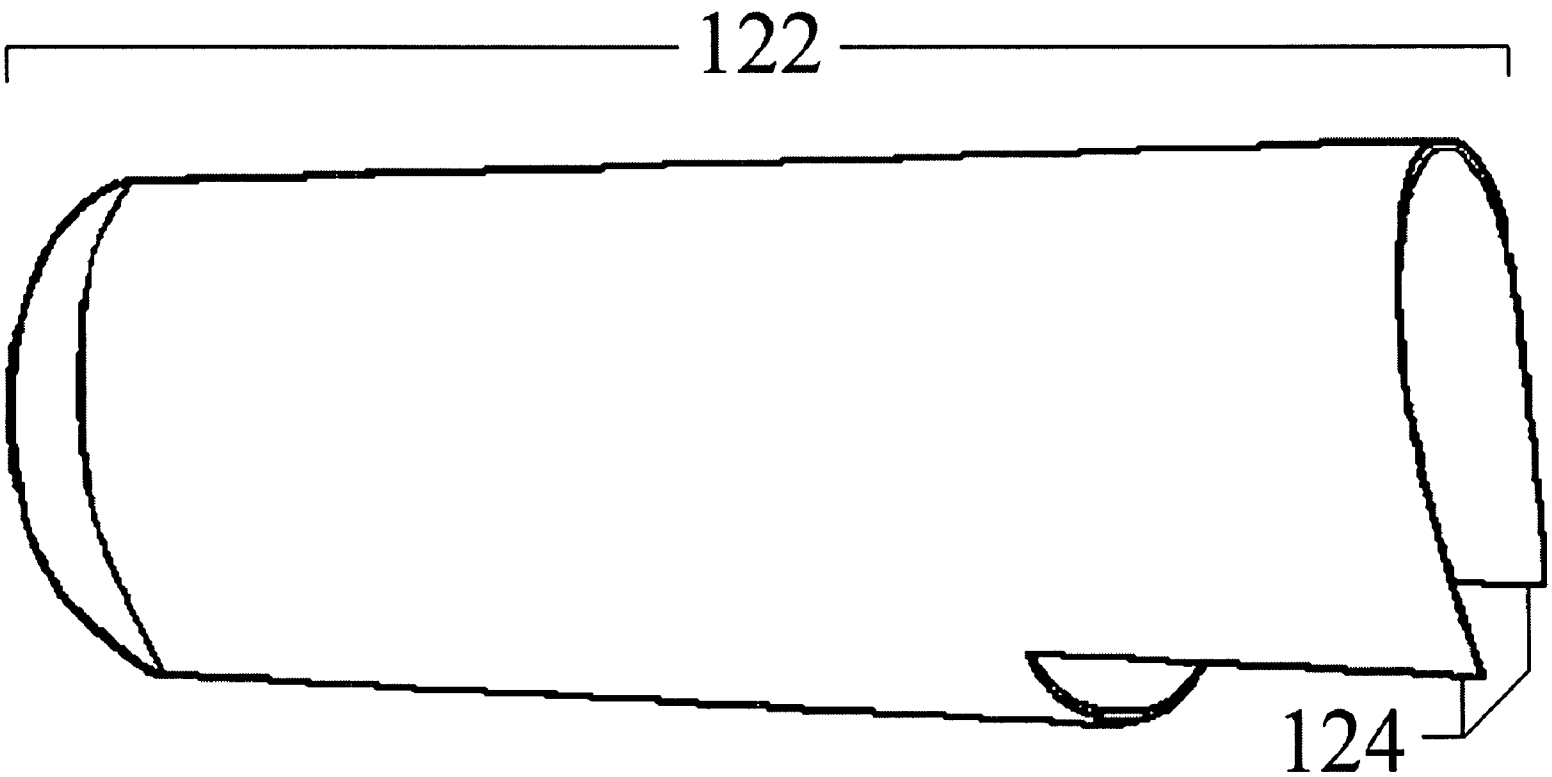
FIG 2A PRIOR ART
FIG. 2A shows an orthogonal view of a known prior art cap.
Figure 2B:
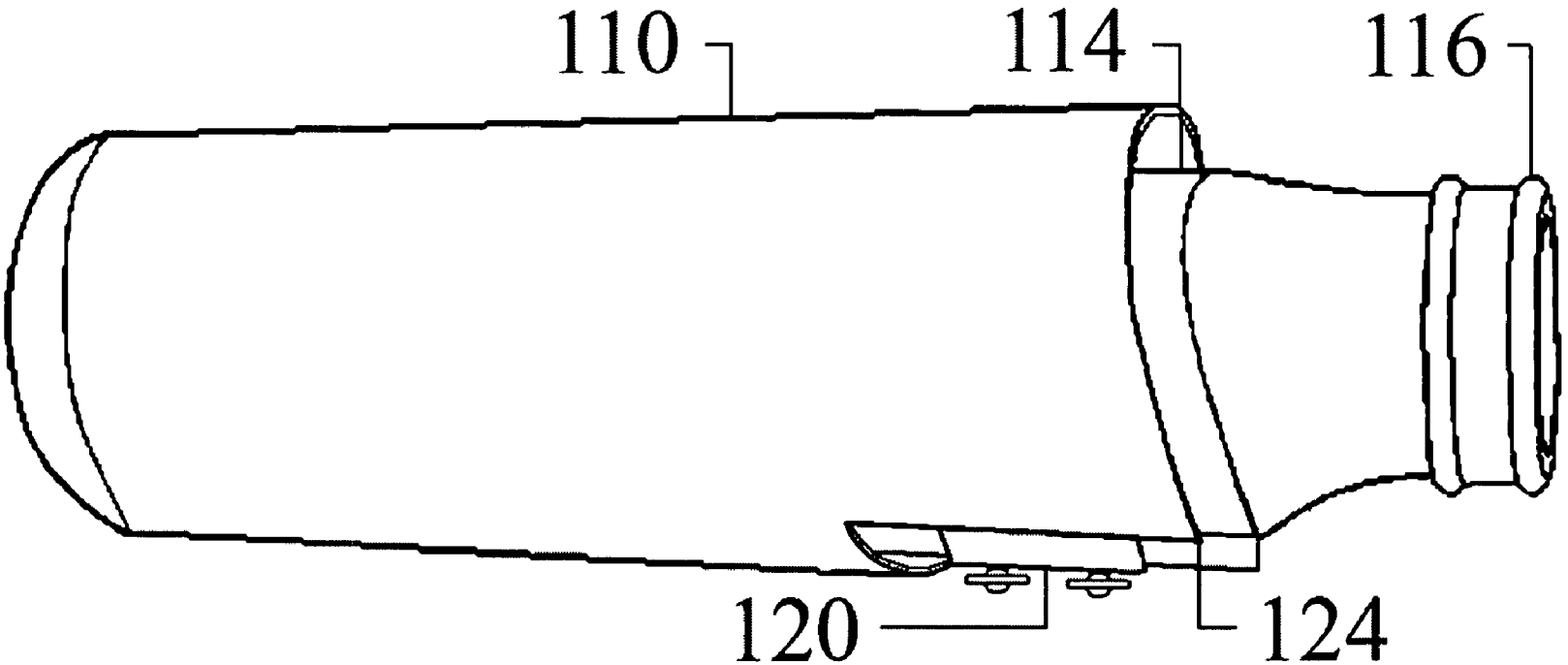
FIG 2B PRIOR ART
FIG. 2B shows an orthogonal view of the prior art cap of FIG. 2A mounted on the mouthpiece of FIG. 1.

FIG. 2A shows a typical known cap 122. The cap 122 has a generally cylindrical body that fits over a portion of the mouthpiece 100. The cap 122 has a cutout 123 with two lateral tabs 124. The purpose of cap 122 is to protect the tip 112 of the mouthpiece 100 and the reed 118 (unless the reed 118 is removed). All saxophone and clarinet mouthpiece caps known to the inventor have been held in place by an interference or pressure fit over the ligature 120, and mouthpiece body 114, as shown in FIG. 2B. The tabs 124 fit over the ligature and made a physical contact with it. Therefore, any motion of the ligature was transmitted to the cap and eventually, the cap could be loosened sufficiently to fall off.

Figure 3A:
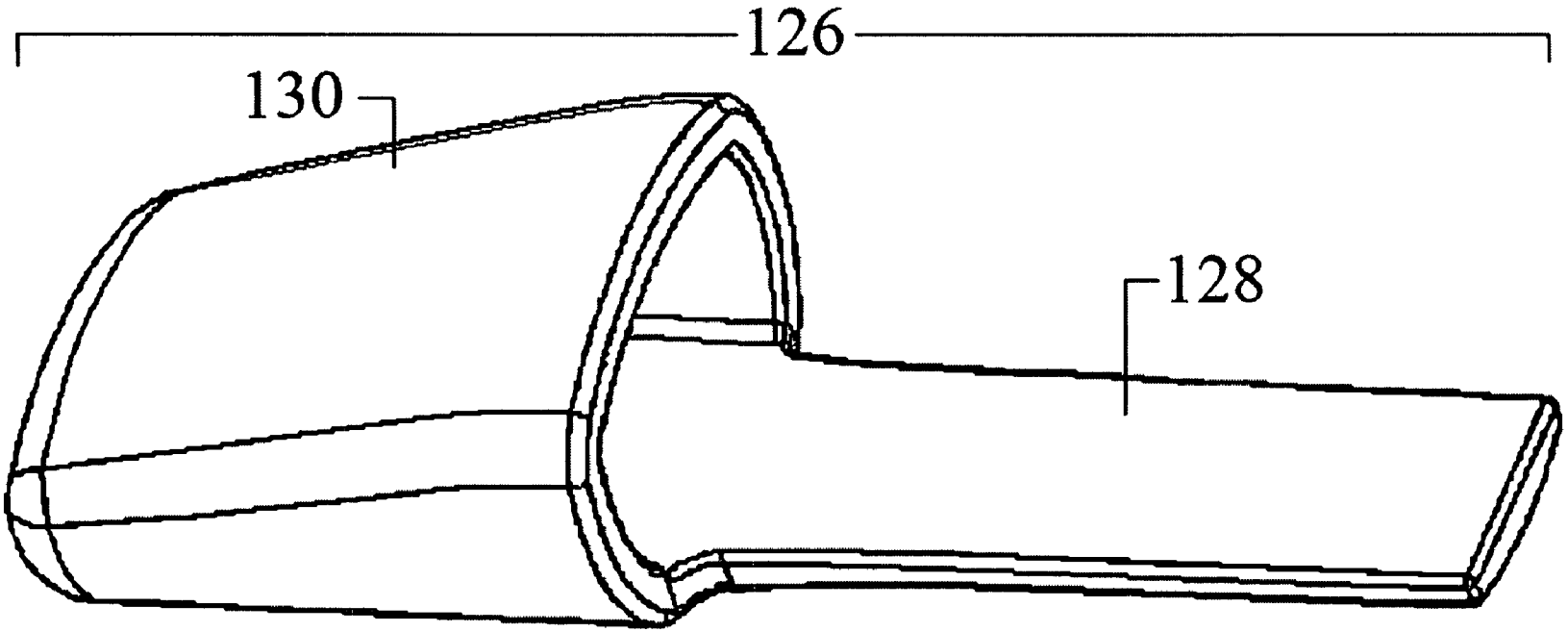
FIG. 3A shows an orthogonal view of a protective cap constructed in accordance with invention.
Figure 3B:
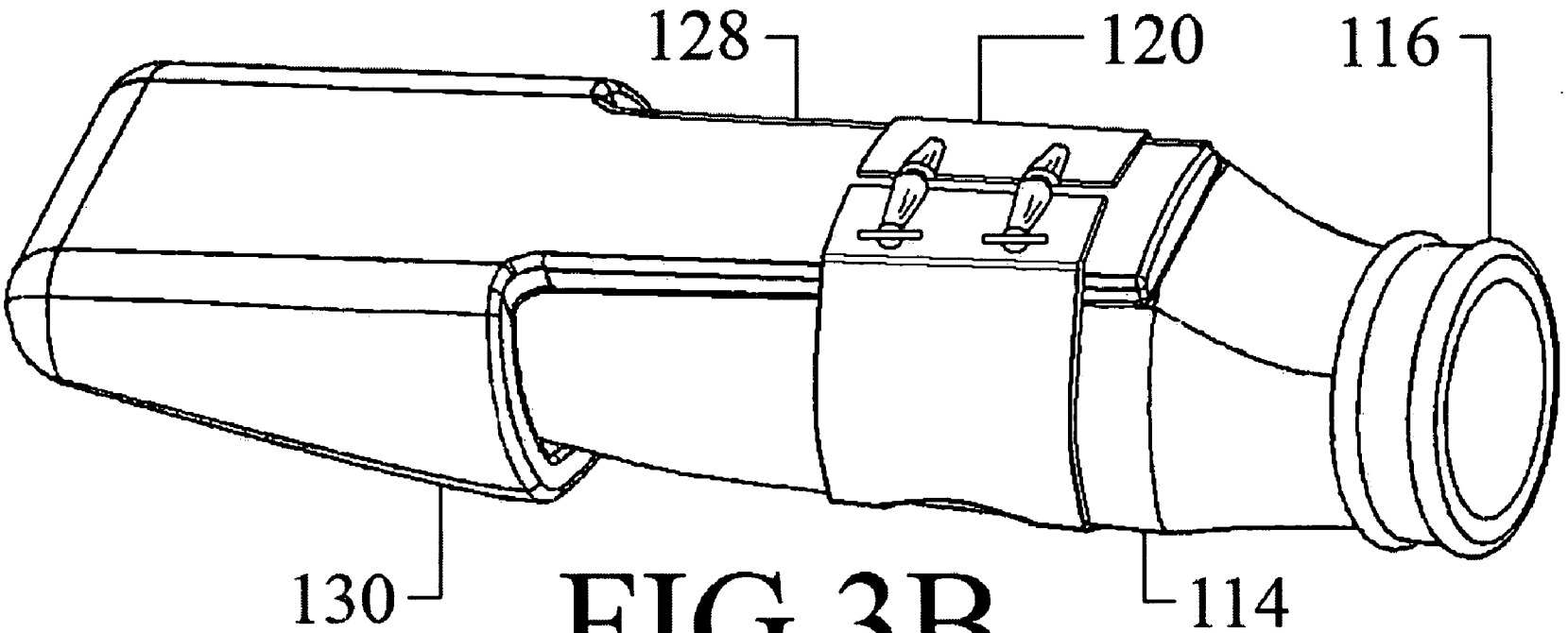
FIG. 3B shows an orthogonal view of the protective cap of FIG. 3A being mounted on the mouthpiece of FIG. 1.
Figure 3C:
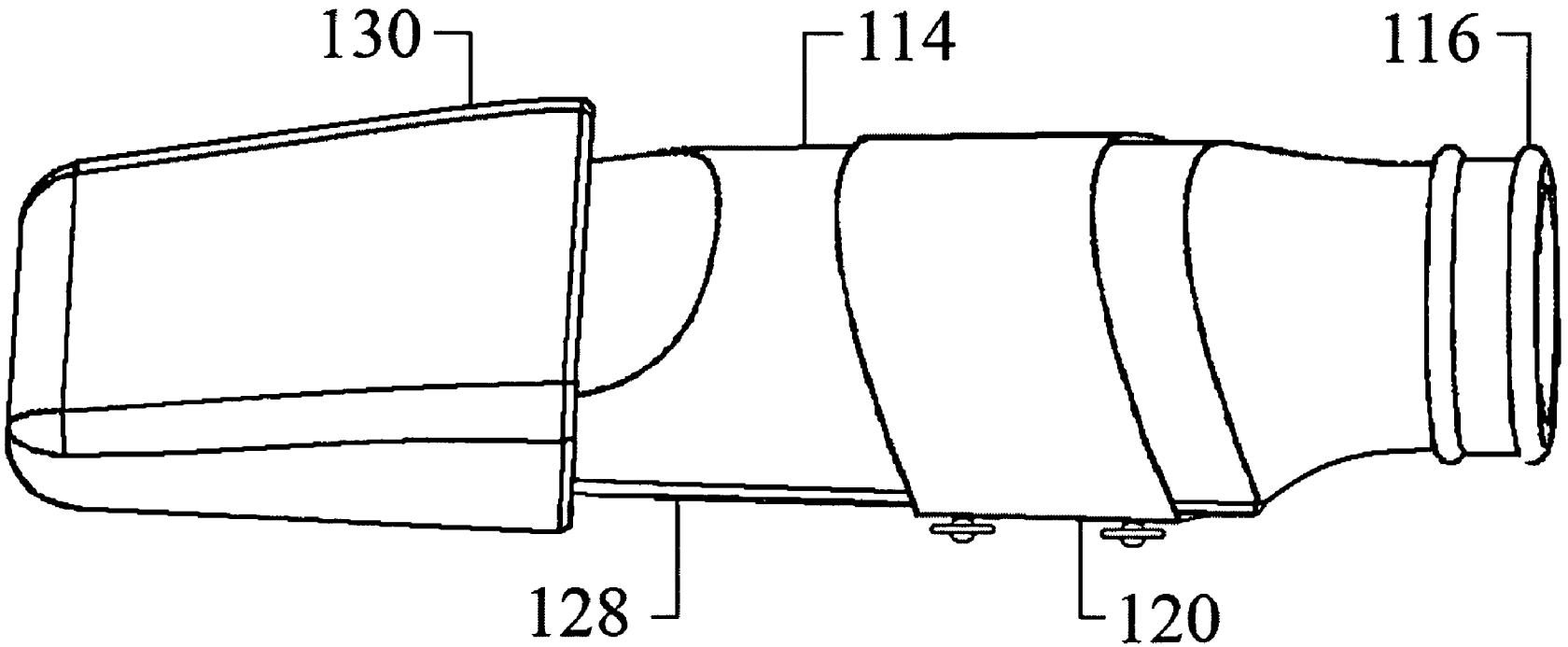
FIG. 3C shows a bottom view of the protective cap of FIG. 3A being mounted on the mouthpiece of FIG. 1.

A novel protective cap constructed in accordance with this invention is shown in FIG. 3A. This cap 126 includes a hollow body 130 that fits over the tip 112 and an extension 128. The extension 128 has the approximate shape and size of the back portion of the reed 118. This cap 126 is used by removing the reed 118 and then placing the cap 126 over the tip 112 with the extension 128 being inserted into the ligature 120 so that it is resting on the reed seat. In effect, the cap 126 takes the place of the reed 118 in the ligature. Once the cap 126 is in place, the thumbscrew 115 is tightened thereby capturing the extension 128 and thereby providing a positive locking mechanism for the cap, as indicated in FIGS. 3B, 3C.

The novel cap 126 has a number of advantages over the prior art cap. Since a reed is very malleable, being made from bamboo cane, it should be removed between uses and stored separately to function properly and not warp or deform. The pressure exerted by the ligature against the reed not only holds the reed in place, but also holds the ligature in place. So when the reed is removed the ligature is loose as well. The new invention allows the ligature to be securely held in place even when the reed is removed for storage. Previously one had to choose between having a properly secured ligature or a properly stored reed.

A further advantage is that previous mouthpiece caps are pressure fit over the ligature. When the ligature is loose, so is the cap. So even with the cap being pressure fit over the ligature there is no way for previous caps to be positively secured in place. On the other hand, the cap disclosed herein is very securely held in place by the ligature. The invention is screwed down in place, whereas previous inventions are only pressure fit over the entire mouthpiece and ligature assembly. Being pressure fit, a traditional cap is prone to move, bend and unexpectedly come off. Moreover, tabs 124 must be bent in to press against ligature, 120, and are the only points where positive contact exists for holding the cap. The present invention provides a much more positive and reliable holding and locking mechanism.

Being held on by the same mechanism (the ligature, 120) that holds the reed, 118, on, the invention is very secure and does not move or unexpectedly come off. One must consciously unscrew the ligature in order to take the cap off. This makes the delicate mouthpiece tip much safer when it is accidentally hit or dropped, a common, though unfortunate, occurrence.

Numerous modifications may be made to this invention without departing from its scope as defined in the appended claims.

I claim:

1. A mouthpiece cap for a musical instrument, said musical instrument including an elongated body with a mouthpiece at one end and a ligature holding a replaceable reed in use, comprising:

a hollow body sized and shaped to fit over the mouthpiece to protect said mouthpiece when the musical instrument is not in use; and an extension attached to said hollow body and shaped to replace said reed and being engaged by said ligature when said hollow body is selectively disposed over said mouthpiece.

2. The mouthpiece cap of claim 1 wherein the ligature includes a screw securing said reed, and wherein said extension is shaped to be captured between said screw and the body of said mouthpiece.

3. The mouthpiece cap of claim 1 wherein said hollow body is shaped to be inserted longitudinally over the mouthpiece with said extension passing simultaneously into said ligature.

4. The mouthpiece cap of claim 1 wherein said hollow body and said extension form a single unitary piece.

5. A cap and mouthpiece assembly comprising:

a mouthpiece having an elongated mouthpiece body with an attachment end for attaching to a musical instrument, a tip and a circumferential surface between said tip and said attachment end;

a ligature disposed on said circumferential surface;

a removable reed having a reed end extending to said ligature and being captured by said ligature; and a cap having a cap body sized and shaped to fit over said tip and an extension attached to said cap body and shaped to extend below and be captured by said ligature;

wherein said reed is replaced by said cap to provide protection to said tip while the musical instrument is idle.

6. The assembly of claim 5 wherein said reed has a reed end captured by said ligature and wherein said extension has the approximate shape and size of said reed end to fit between said ligature and the mouthpiece body.

7. The assembly of claim 5 wherein said ligature includes a capture screw for selectively capturing one of said reed and said cap.

8. The assembly of claim 5 wherein one of an end of said reed and said extension are captured between said screw and said mouthpiece.

9. The assembly of claim 5 wherein said cap and said extension are forming a unitary piece.

10. The assembly of claim 5 wherein said attachment is selected to mount said body to a clarinet.

11. The assembly of claim 5 wherein said attachment is selected to mount said body to a saxophone.

* * * * *